US007018284B2

(12) United States Patent
Seo

(10) Patent No.: US 7,018,284 B2
(45) Date of Patent: Mar. 28, 2006

(54) APPARATUS FOR SORTING AND COUNTING COINS

(75) Inventor: Hwa Il Seo, Cheon An-Si (KR)

(73) Assignee: Royal Sovereign Inc., (KR)

( * ) Notice: Subject to any disclaimer, the term of this patent is extended or adjusted under 35 U.S.C. 154(b) by 0 days.

(21) Appl. No.: 10/861,368

(22) Filed: Jun. 7, 2004

(65) Prior Publication Data

US 2004/0242142 A1 Dec. 2, 2004

Related U.S. Application Data

(63) Continuation of application No. PCT/KR2002/002287, filed on Dec. 5, 2002.

(51) Int. Cl.
*G07D 3/00* (2006.01)

(52) U.S. Cl. ..... 453/3; 453/31

(58) Field of Classification Search ..... 453/3, 453/9, 12, 13, 14, 18, 29, 30, 31, 32, 33, 453/57, 58, 59, 61; 53/447, 532, 212
See application file for complete search history.

(56) References Cited

U.S. PATENT DOCUMENTS 957,332 A * 5/1910 Hastings ..... 209/680
1,200,843 A * 10/1916 Johnson et al. ..... 453/12
3,174,488 A * 3/1965 Rau ..... 453/3
4,466,453 A * 8/1984 Said et al. ..... 453/8
5,662,520 A * 9/1997 Evdokimo ..... 453/3

* cited by examiner

*Primary Examiner*—Donald P. Walsh
*Assistant Examiner*—Mark Beauchaine
(74) *Attorney, Agent, or Firm*—Edell, Shapiro & Finnan LLC

(57) ABSTRACT

An apparatus for sorting and counting coins includes a bi-directionally rotatable motor, a rotating shaft for conveying a rotating force generated by the motor, a stopper in contact with the rotating shaft having a tilted end to limit counterclockwise rotation, a conveying container engaged with the rotating shaft having conveying holes for loading coins, a supply control container formed on an upper side of the conveying container and having supply holes for supplying coins to the conveying container while rotating, sorting holes being of different sizes to conform with the conveying holes for sorting coins according to sizes thereof; a sensor for counting coins, and a mechanism for containing coins in a coin receiver by suspending rotation of the conveying container after a predetermined number of coins have fallen in the coin receiver and before a next coin of the same kind falls from a sorting hole.

14 Claims, 11 Drawing Sheets

Horizontal axis-2V per a scale, Vertical axis-100ms per a scale

APPARATUS FOR SORTING AND COUNTING COINS

CROSS REFERENCE TO RELATED APPLICATIONS

This application is a continuation of PCT Application No. PCT/KR2002/002287, filed on Dec. 5, 2002, and titled "Apparatus for Sorting and Counting Coins," which claims priority from Korean Patent Application No. 10-2001-37911, filed on Dec. 7, 2001, and titled "Apparatus for Sorting and Counting Coins," the entire contents of which are hereby incorporated by reference.

TECHNICAL FIELD

The present invention is related to an apparatus for sorting and counting coins.

The apparatus for sorting and counting coins is an apparatus for sorting coins in accordance with kinds thereof and containing a predetermined number of coins in each coin receiver. This apparatus is mainly used in financial institutes such as banks or in the places requiring a rapid and precise sorting of coins.

BACKGROUND ART

FIG. 1 is a perspective view of a conventional rotative apparatus for sorting and counting coins illustrating an external shape thereof.

Referring to FIG. 1, the conventional rotative apparatus for sorting and counting coins comprises a coin slot 110 for inputting coins, a guide 130 for sorting the inputted coins in accordance with sizes thereof, a coin receiver 140 for receiving a predetermined number of sorted coins, a coin-collecting drawer 150 for collecting the coins failed to be received by the coin receiver 140, and a power supplying apparatus 160 for supplying or interrupting power to and form the apparatus for sorting and counting coins.

The following is a brief description of an operational mechanism of the apparatus for sorting and counting coins as constructed above.

If a user switches on the power supplying apparatus 160 and inputs coins into the coin slot 110, the coins are sorted by the sorting device at a lower side of the coin slot 110. The sorted coins are outputted by the guide 130.

The coins outputted by the guide 130 are received by the coin receiver 140. The coin receiver 140 is manufactured to have a height for receiving a predetermined number of coins. Once a predetermined number of coins are received up to the predetermined height of the coin receiver, the excessive coins failed to be received by the coin receiver fall into the coin-collecting drawer 150. As shown in FIG. 1, where the coin receiver 140 comprises two containers, and if a first container of the coin receiver 140 adjacent to the guide 130 is filled up, the excessive coins failed to be received by the first container are received by the second container of the coin receiver 140.

If the coins have filled up the coin receiver 140, the user switches off the power supplying apparatus 160 and detaches the coin receiver 140 from the apparatus for sorting and counting coins to use the sorted coins for desired purposes.

FIG. 2 is a cross-sectional view of the conventional rotative apparatus for sorting and counting coins.

Referring to FIG. 2, the conventional apparatus for sorting and counting coins comprises a coin slot 110 for inputting coins, a supply controlling container 111 for controlling a considerable number of coins inputted into the coin slot 110 so that a small number of coins can be inputted into a sorting apparatus, a supplying outlet formed on a side surface of the supply control container 111 for inputting a small number of coins, a cover 115 for preventing the coins from leaving outside of the rotating supply controlling container 111, a conveying container 113 for conveying the coins inputted through the supplying outlet 112 so as to be sorted by conveying holes 114 and sorting holes 116, a rotating shaft 118 for rotating the supply control container 111 and the conveying container 113, and a motor 117.

The conventional apparatus for sorting and counting coins further comprises a guide 130 for separately receiving the coins sorted by the sorting holes 116, a coin receiver 140 for receiving the coins sorted by the guide in accordance with sizes of the coins, a receiving container 141 for receiving the coin receiver 140, and a coin-collecting drawer 150 for collecting the coins failed to be received by the coin receiver 140.

The following is a brief description of an operation of the conventional apparatus for sorting and counting coins as constructed above.

If a considerable number of coins are inputted through the coin slot 110, the coins are accumulated in the supply control container 111. As the supply control container 111 rotates, a small number of coins are inputted into the conveying container 113 through the supplying outlet 112 formed on a side surface of the supply control container 111.

As the conveying container 113 rotates, the coins are inserted into the conveying hole 114 formed on the conveying container 113, and conveyed to the sorting hole 116.

The sorting holes 116 comprise a number of holes of different sizes formed in the order of small to large sizes along the rotating line of the conveying hole 114.

Accordingly, the coins of smaller sizes are outputted first from the sorting holes 116 while the coins of the largest size are outputted from the sorting hole in the last order.

The supply control container 111 and the conveying container 113 are rotated by the rotating shaft 118 and the motor 117 formed at a lower side of the conveying container 113.

The coins sorted by the sorting holes 116 are received by the coin receiver 140 in a state of having been sorted by the guide 130.

The coin receiver 140 may comprise multiple containers in accordance with the sizes of the coins. As shown in FIG. 2, the coin receiver 140 may comprise two containers for the coins of the same size.

If both the two containers of the coin receiver 140 have been filled up by the coins, the excessive coins fall down into the coin-collecting drawer 150.

Once the coin sorting is completed, the user detaches the coin receiver 140 from the apparatus for sorting and counting coins so as to sort the coins in a different manner.

FIG. 3 is a perspective view of a coin supplier separated from the conventional rotative apparatus for sorting and counting coins.

Referring to FIG. 3, the conventional rotative apparatus for sorting and counting coins comprises a supply control container 111 having a concave portion in the middle and including a supplying outlet 112 on a side surface for supplying a predetermined number of coins when rotated, a cover 115 engaged with an upper side of the supply control container 111 and having a coin slot 110 in the middle for preventing coins from leaving outside of the apparatus for sorting and counting coins, a conveying container 113 formed on a lower side of the supply control container 111 and including conveying holes 114 for loading each coin, sorting holes 116 having a plurality of holes of different sizes for sorting the coins conveyed by the conveying holes 114 in accordance with sizes, a motor 117 for generating power, a rotating shaft 118 for conveying the rotating the power generated from the motor 117, a gear 120 rotated along the rotating shaft 118 and having a protrusion, a stopper 119 having an angle at the tip thereof so that the rotating direction of the gear 120 can be interfered, and a spring for supplying an elastic force to the stopper 119.

The following is a description of an operational mechanism of the conventional coin supplier as constructed above.

The gear 120, the conveying container 113 and the supply control container 111 are constructed to rotate around the same rotating shaft 118. If the coins are inputted through the coin slot 110, a predetermined number of coins are supplied to the conveying container 113 through the supplying outlet 112 formed on a side surface of the supply control container 111.

As the conveying container 113 rotates, each of the coins supplied to the conveying container 113 is loaded and conveyed to the plurality of conveying holes 114 formed on a side surface of the conveying container 113 so as to be sorted by the sorting holes of different sizes.

However, the coin supplier operated as above has a drawback that a coin is sorted while passing one of the sorting holes 116 as soon as the conveying hole 114 coincides with one of the sorting holes 116. Since the conveying holes 114 continuously rotate, and if a coin fails to timely pass one of the sorting holes 116, the coin is trapped between one of the conveying holes 114 and one of the sorting holes 116. This results in interruption of an operation of the apparatus for sorting and counting coins.

To resolve this problem, the gear 120 including a protrusion has been installed in the rotating shaft 118. The stopper 119 is also utilized to smooth rotation of the conveying container 113 by interfering the rotating direction of the gear 120.

FIG. 4 is a schematic diagram illustrating an operation of the gear including a protrusion and the stopper in the coin supplier of the conventional rotative apparatus for sorting and counting coins.

Referring to FIGS. 3 and 4, the gear 120 is formed on the rotating shaft, which is rotated by the power generated from the motor 117 to smooth rotation of the conveying container 113. A plurality of protrusions 121 are formed around the periphery of the gear 120.

A stopper 119 is formed on a housing 122 at one side of the gear 120 to receive an elastic force of a spring 123. The stopper 119 has a tilted end so as not to interrupt rotation of the gear 120 due to the elastic force of the spring 123 when the gear 120 rotates in the clockwise direction, and to interrupt rotation of the gear 120 due to interlocking of the protrusions 121 formed on the gear 120 with the stopper 119 when the gear 120 rotates in the anti-clockwise direction.

It is preferable to round the external surface of the protrusions 121 in a circular shape so that the gear 120 can be less interrupted by the stopper 119 when rotated in the clockwise direction.

The motor 117 has a bi-directional structure. That is, the motor 117 first rotates in the clockwise direction. If interrupted by an external force, the motor 117 rotates in the anti-clockwise direction. If interrupted by the external force once again, the motor 117 then rotates in the clockwise direction.

The conveying container 113 engaged with the rotating shaft 118 of the motor 117 also has a bi-directional structure. The coins are sorted as the sizes of the sorting holes 116 become larger along the clockwise direction. Therefore, if the conveying container 113 continues to rotate in the anti-clockwise direction, the coins of relatively smaller sizes pass through the sorting holes 116 of relatively larger sizes. Thus, the coins cannot be sorted in an appropriate manner.

To resolve this problem, the stopper 119 was designed to have a tilted end while the gear 120 was designed to have protrusions 121 on its external surface so as to prevent the conveying container 113 from further rotating in the anti-clockwise direction than a predetermined angle.

To be specific, the stopper 119 is suspended on the protrusions 121 when the conveying container 113 rotates in the anti-clockwise direction. As a consequence, the conveying container 113 does not further rotate in the anti-clockwise direction than a predetermined angle.

When the conveying container 113 rotates in the anti-clockwise direction, the coin inserted between the conveying hole 114 and the sorting holes 116 to interrupt operation of the coin supplying device is released. The conveying container 113 then once again rotates in the clockwise direction after further rotating in the anti-clockwise direction than a predetermined angle. Therefore, the coins of smaller sizes are not sorted through the sorting holes 116 of larger sizes, thereby restoring proper sorting of the coins.

Meanwhile, some of the conventional apparatuses for sorting and counting coins have a function of displaying the number of coins or amount by simply counting the number of coins passing each guide 130 with a sensor installed at the guide 130.

As described above, the conventional apparatus for sorting and counting coins utilizes the height of the coin receiver 140 to contain a predetermined number of coins in the coin container 140, i.e., to count the coins.

However, the conventional apparatus for sorting and counting coins poses the following problems. First, where coins have different sizes in their thickness or shape in accordance with the year of manufacturing, the coin receiver 140 fails to receive a predetermined number of coins. In other words, a predetermined number of coins cannot be received by the coin receiver 140. Second, since the coins bounce down the guide 130 due to an impact of falling from the sorting holes 116, the coins are apt to pass the first coin receiver 140 and fall down the second coin receiver or the coin-collecting drawer 150 even if the first coin receiver 140 has not yet been fulfilled. Thus, it is difficult to contain a predetermined number of coins in the coin receiver 140. Furthermore, it is inconvenient to collect the coins fell outside of the coin receiver 140. As such, the conventional apparatus for sorting and counting coins carries a low efficiency.

As described above, the conventional apparatus for sorting and counting coins poses a significant problem in counting the coins despite its capability of sorting the coins. Such problem still remains in some of the conventional apparatus having an additional function of displaying the number of coins or amount with a sensor installed at the guide because the displayed number of coins or amount is the total number or amount of the coins including the one in the coin-collecting drawer.

DISCLOSURE OF INVENTION

It is, therefore, an object of the present invention to provide new means and an apparatus for counting coins capable of effectively solving the problems of the conventional apparatus for sorting and counting coins.

To achieve the above object, there is provided an apparatus for sorting and counting coins, comprising: a bi-directionally rotatable motor; a rotating shaft for conveying a rotating force generated by the motor; a stopper installed with a predetermined interval with the rotating shaft and having a tilted end so as not to further rotate in an anti-clockwise direction than a predetermined angle; a spring for allowing an elastic force to the stopper; a conveying container engaged with the rotating shaft and having conveying holes on a side surface for loading each coin; a supply control container formed on an upper side of the conveying container and having supply holes on a side surface for supplying a predetermined number of coins to the conveying container while rotating; sorting holes having a plurality of holes of different sizes to conform with the conveying holes for sorting coins in accordance with the sizes thereof; means for counting coins by using a non-contact type sensor; and means for containing a predetermined number of coins in a coin receiver by suspending the conveying container after a predetermined number of coins have fallen in the coin receiver and before a next coin of the same kind falls from a sorting hole.

The apparatus for sorting and counting coins according to the present invention preferably further comprises means for sorting and counting coins by re-operating the conveying container once the coin receiver is remounted on the apparatus in an empty state after a predetermined number of coins are received by the coin receiver and removed from the same.

Preferably, the means for counting coins according to the present invention counts coins by sensing side surfaces of the falling coins before the coins arrive at the guide after falling from the sorting holes by using a reflection-type photo interrupter.

More preferably, the means for counting coins according to the present invention counts coins by sensing front or rear surfaces of coins sliding the guide by using a transmissive photo interrupter, a luminous diode or a photo transistor (or a photo diode).

Preferably, the coin receiver according to the present invention comprises a wrapper case and a coin wrapper. Once the coin receiver receives a predetermined number of coins, the coin wrapper containing the coins is detached from the apparatus for sorting and counting coins, and re-attached thereto in an empty state.

More preferably, the means for sorting and counting coins by operating the conveying container senses a new coin wrapper by using the reflection-type photo interrupter.

More preferably, the means for re-operating the conveying container uses a switch.

BRIEF DESCRIPTION OF DRAWINGS

The above object, features and advantages of the present invention will become more apparent from the following detailed description when taken in conjunction with the accompanying drawings, in which.

BEST MODES FOR CARRYING OUT THE INVENTION

Figure 1:
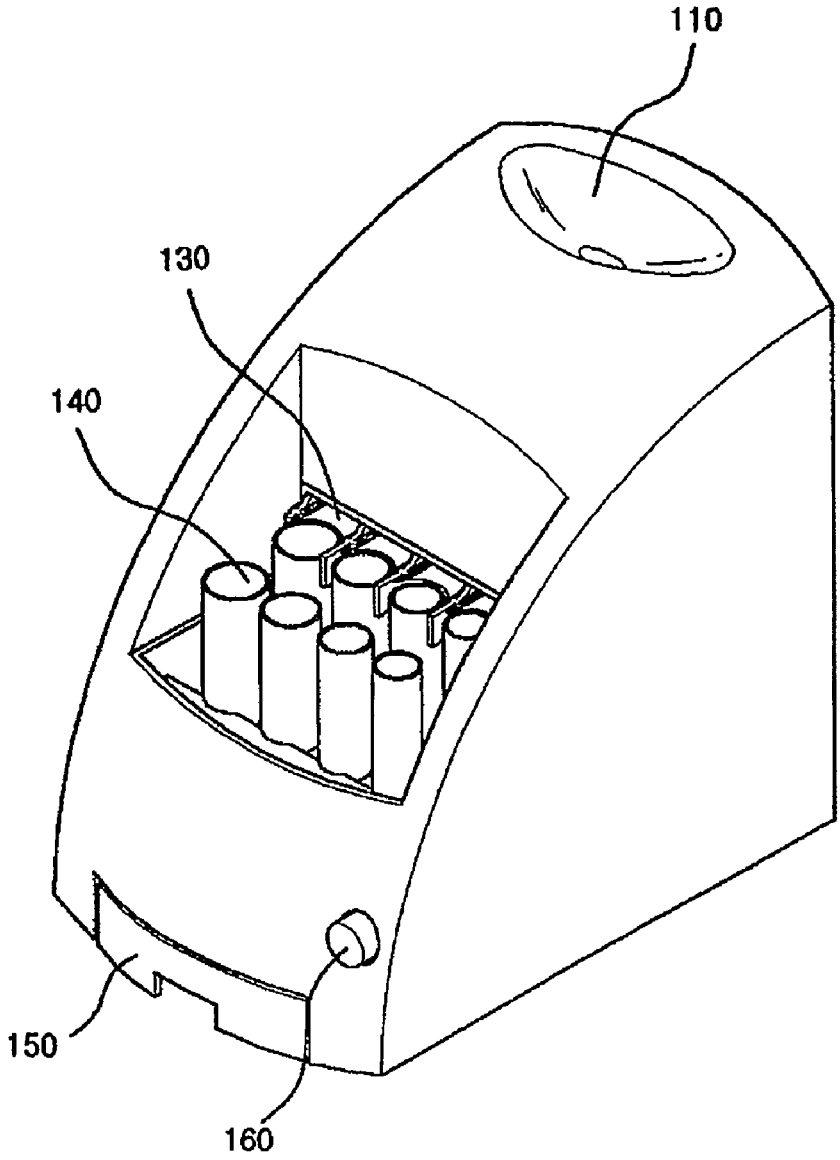
FIG. 1 is a perspective view of a conventional apparatus for sorting and counting coins illustrating an external shape thereof.
Figure 2:
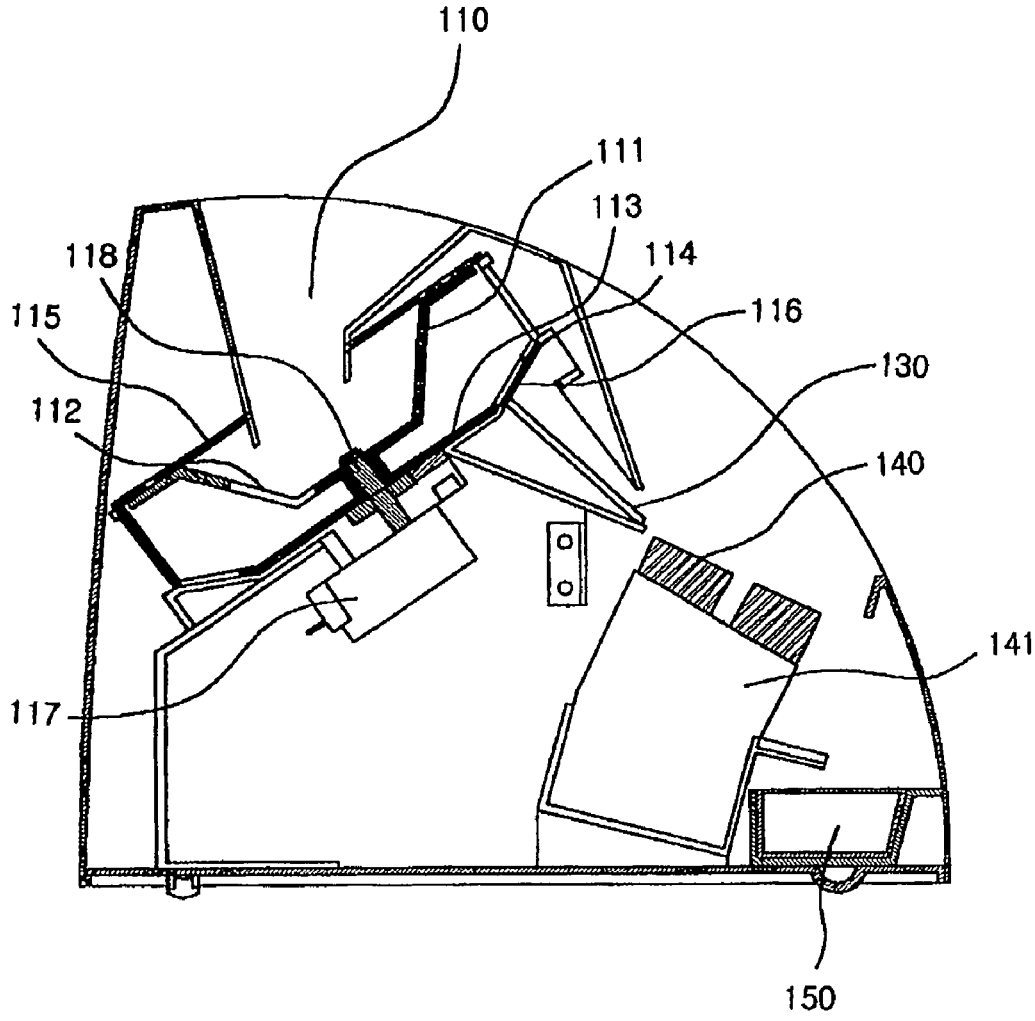
FIG. 2 is a cross-sectional view of a conventional rotative apparatus for sorting and counting coins.
Figure 3:
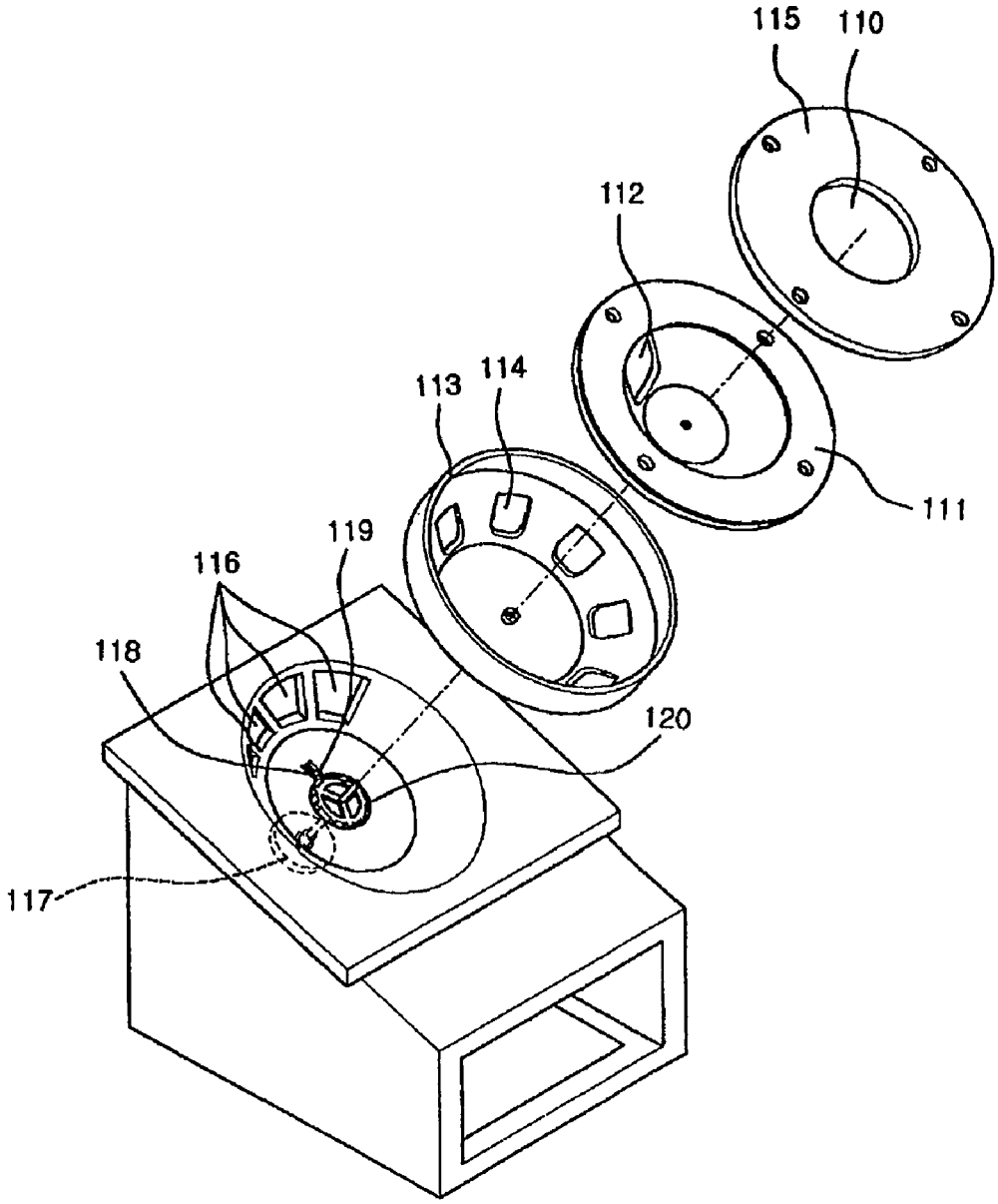
FIG. 3 is a perspective view of a coin supplier separated from the conventional rotative apparatus for sorting and counting coins.
Figure 4:
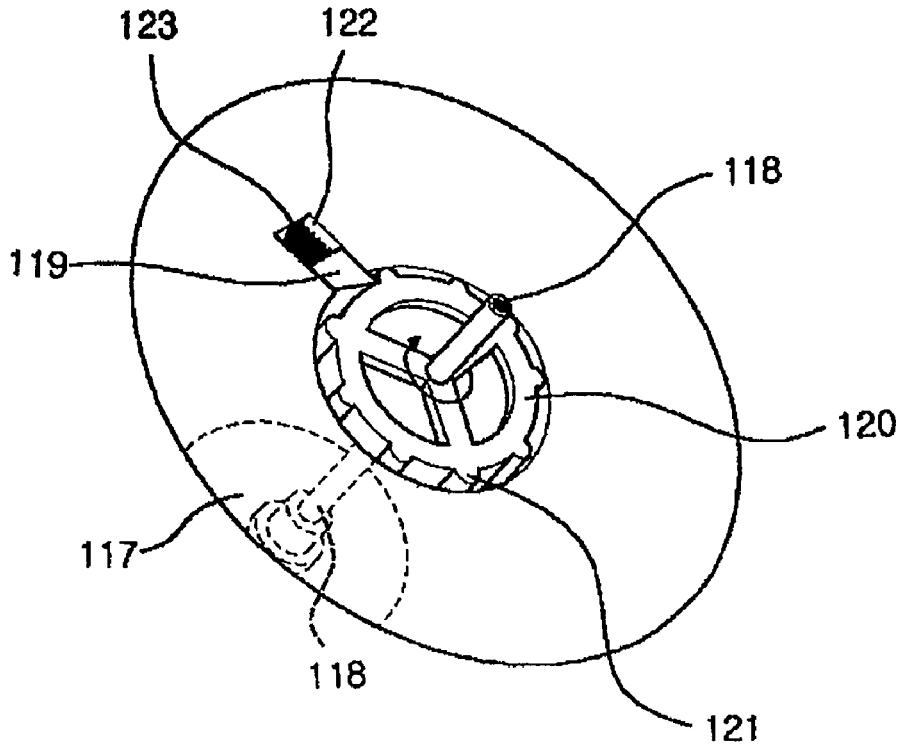
FIG. 4 is a schematic diagram illustrating an operation of the gear including a protrusion and the stopper in the coin supplier of the conventional rotative apparatus for sorting and counting coins.

Best modes for carrying out the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

The present invention includes means for counting coins by using a sensor when coins either fall from the sorting holes 16 or slide from the guide 130, means for interrupting the conveying container 13 by suspending the motor before a next coin of the same kind falls from one of the sorting holes 16, and means for sorting and counting either by sensing an empty state of the coin receiver once the coins counted by the coin receiver or by pressing a separate switch to re-operate the motor.

Accordingly, the present invention is capable of containing accurate number of coins in the coin receiver by interrupting the conveying container 13 before a next coin of the same kind falls from one of the sorting holes 16 once after a predetermined number of coins have fallen from the sorting holes. The present invention is also capable of preventing coins from falling outside of the wrapper by structuring the wrapper case to have a higher height on the opposite upper side than the side where the coins fall. Thus, the wrapper can hold all the sorted coins that can be accurately counted and collected.

The apparatus for sorting and counting coins according to the present invention will now be described in detail with reference to FIGS. 5 to 13.

The present invention employs a photo interrupter or an individual luminous diode and a photo transistor (or a photo diode) as a coin sensor. The photo interrupter is an integration of the luminous diode and the photo transistor (or the photo diode). Either a reflection-type or a transmissive type photo interrupter may be used.

The present invention is characterized by sensing a coin in advance before it falls from one of the sorting holes 16. Assuming that the number of conveying holes 14 formed in the conveying container 13 is N, and the time consumed for the conveying container 13 to rotate once is T, the minimum time $T_L$ consumed for a next coin of the same kind to fall from a sorting hole 16 to the guide 30 can be expressed by the following equation:

$$T_L=T/N$$

To be specific, a next coin is sensed within the time $T_L$ after the coin fell from a sorting hole 16. To this end, it is critical either to sense the coin before it arrives at the guide 130 after it fell from the sorting hole 16 or to sense the coin immediately after the coin fell into the guide 130. It is difficult to sense the coin either immediately before it arrives at the guide 30 after falling from the sorting hole 16 or immediately after the coin fell into the guide 30.

Figure 5:
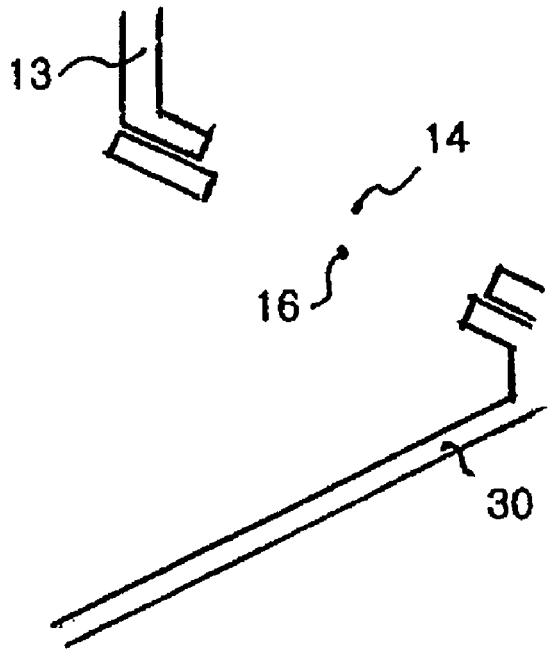
FIG. 5 is a cross-sectional view of a conveying hole and a sorting hole of a rotative apparatus for sorting and counting according to the present invention.

FIG. 5 is a cross-sectional view of the conveying hole 14 and the sorting hole 16 of a rotative apparatus for sorting and counting according to the present invention.

Figure 6:
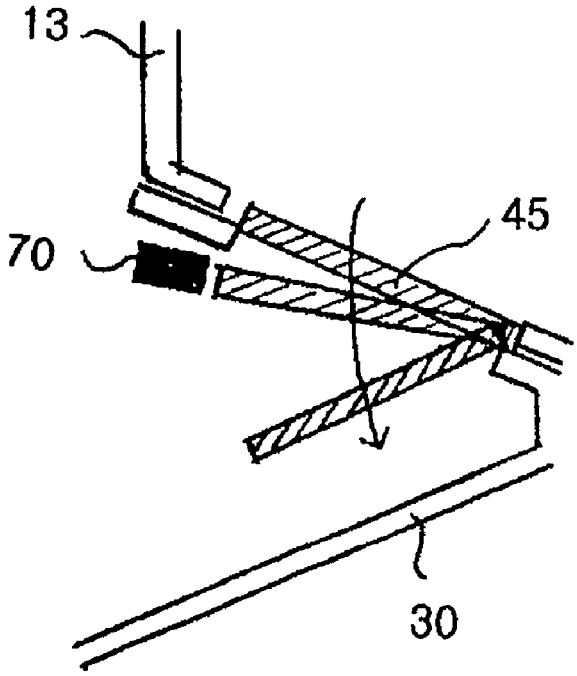
FIG. 6 is a cross-sectional view of the apparatus for sorting and counting coins according to a best mode for carrying out the present invention, in which a side surface of a coin is sensed by a reflection-type photo interrupter or a luminous diode as the coin falls from a sorting hole.

FIG. 6 is a cross-sectional view of the apparatus for sorting and counting coins according to a best mode for carrying out the present invention, in which a side surface of a coin is sensed by a reflection-type photo interrupter or a luminous diode as the coin falls from a sorting hole.

Figure 7:
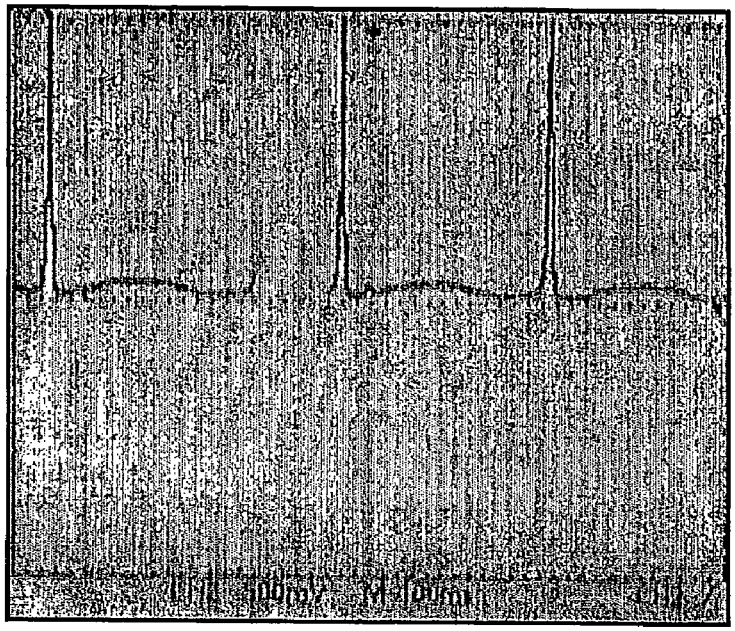
FIG. 7 is a view illustrating a waveform outputted by the photo interrupter in FIG. 6.

FIG. 7 is a view illustrating a waveform outputted by a sensor when sensing the coin 45 in FIG. 6. This confirms that a clear signal can be obtained even if a side surface of the coin is sensed.

Figure 8:
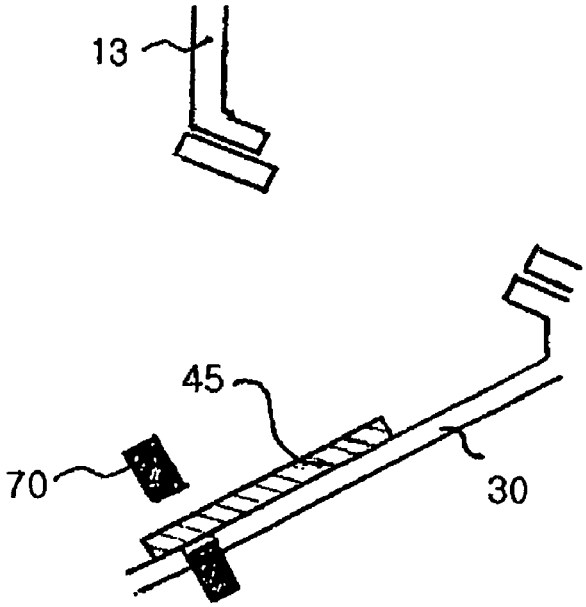
FIG. 8 is a cross-sectional view of the apparatus for sorting and counting coins according to the best mode for carrying out the present invention, in which a coin is sensed by the luminous diode and the photo transistor (or a photo diode) or a transmissive photo interrupter of as the coin slides from a guide.

FIG. 8 is a cross-sectional view of the apparatus for sorting and counting coins according to the best mode for carrying out the present invention, in which the coin 45 is sensed by the luminous diode and the photo transistor (or a photo diode) or a transmissive photo interrupter 70 of as the coin 45 slides from a guide. Meanwhile, it is also possible to sense the coin 45 sliding from the guide 30 by using a reflection-type interrupter.

Figure 9:
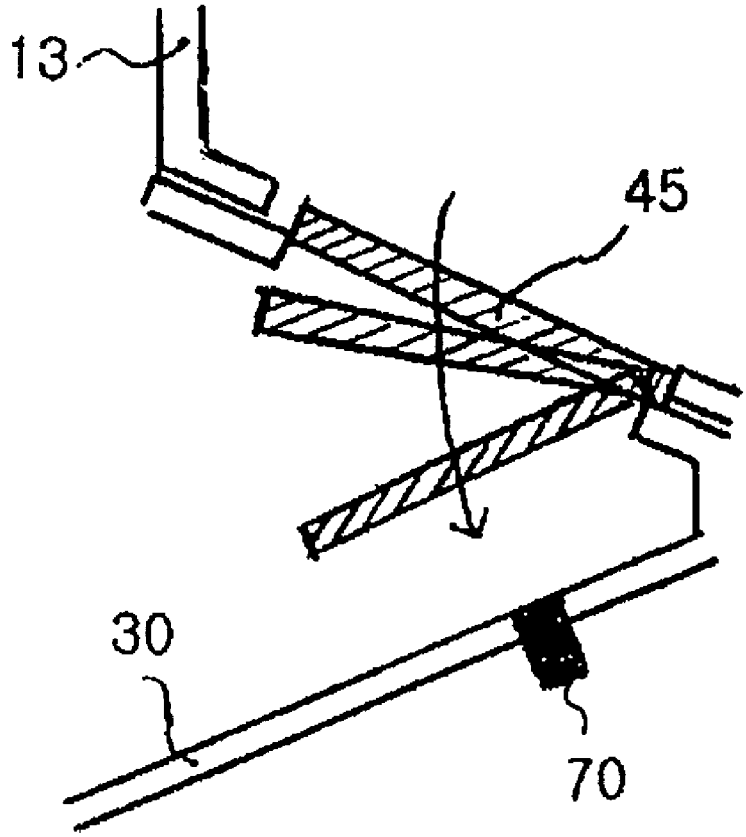
FIG. 9 is a cross-sectional view of the apparatus for sorting and counting coins according to the best mode for carrying out the present invention, in which a coin is sensed by the reflection-type photo interrupter or the luminous diode and the photo transistor (or the photo diode) of as the coin falls from a sorting hole.

FIG. 9 is a cross-sectional view of the apparatus for sorting and counting coins according to the best mode for carrying out the present invention, in which the coin 45 is sensed by the reflection-type photo interrupter or the luminous diode and the photo transistor (or the photo diode) of as the coin 45 falls from a sorting hole.

Figure 10:
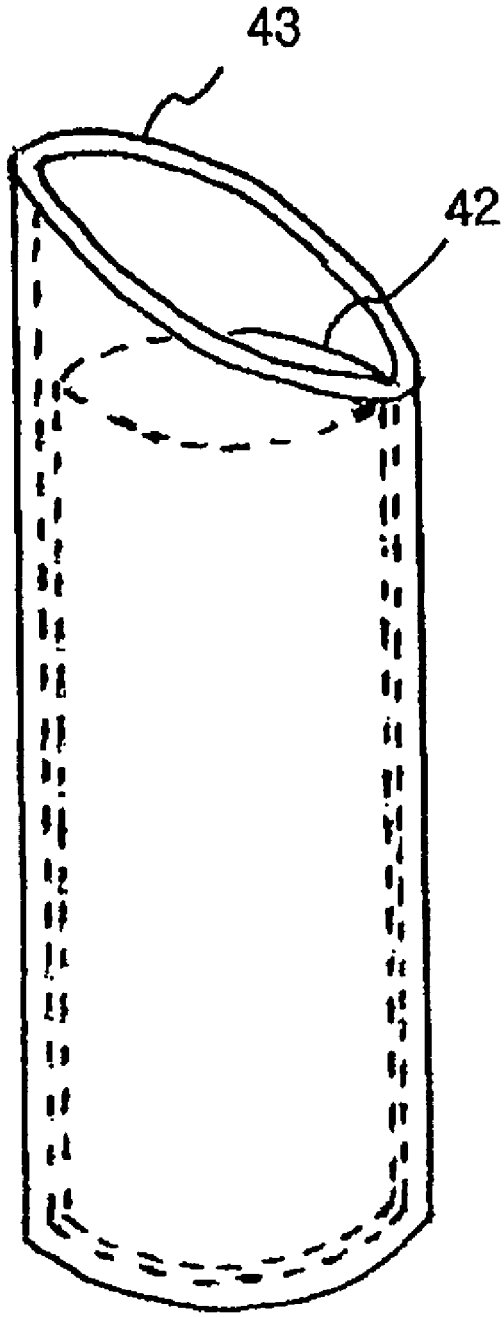
FIG. 10 is a perspective view of a coin receiver of the apparatus for sorting and counting coins according to the best mode for carrying out the present invention illustrating an external shape thereof.

According to the present invention, the coin receiver comprises a coin wrapper 42 and a wrapper case 43. The coin wrapper 42 is a kind of wrapping paper that can be used in the course of commercial transaction such as banks when packing coins. Since the present invention does not count coins in accordance with the height of the coin receiver, the height of the coin wrapper 42 does not matter. The wrapper case 43, which is to physically support the coin wrapper 42, may be fixed on the apparatus for sorting and counting coins. To prevent coins from falling outside of the coin wrapper, it is necessary to elongate the opposite upper side where the coins fall to have a height as shown in FIG. 10. In that case, even the coins bouncing the guide 30 fall into the coin wrapper 42. Therefore, the coin wrapper 42 can hold all the counted coins. Meanwhile, the wrapper case 43 may take a shape of a cylinder or a shape excluding a part from the cylinder so that the coin wrapper 42 can be easily drawn therefrom.

If the conveying container is suspended after a predetermined number of coins have been contained in the coin wrapper 42 according to the present invention, the coin wrapper 42 containing the coins is removed from the coin wrapper 42, and an empty coin wrapper is mounted on the apparatus. Then, either the empty coin wrapper is sensed by a sensor, or the conveying container is re-operated by using a switch. The present invention uses a reflection-type photo interrupter to sense a new coin wrapper.

Figure 11:
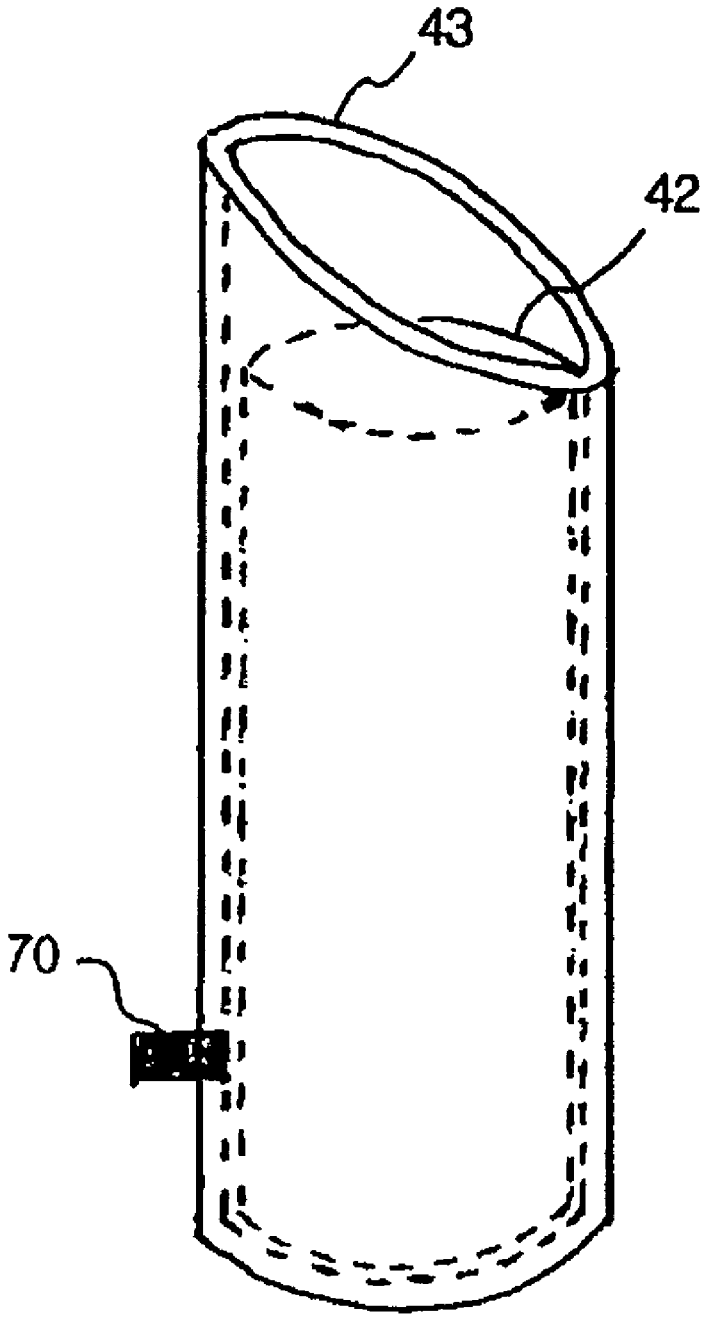
FIG. 11 is a perspective view of a coin wrapper sensed by the reflection-type interrupter mounted on a wrapper case of the apparatus for sorting and counting coins according to the best mode for carrying out the present invention.

FIG. 11 is a perspective view of the coin wrapper 42 sensed by the reflection-type interrupter mounted on the wrapper case 43 of the apparatus for sorting and counting coins according to the best mode for carrying out the present invention.

Figure 12:
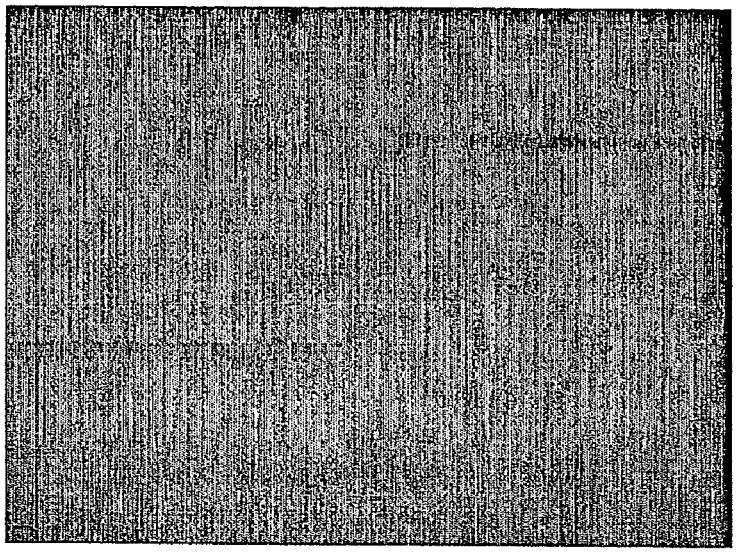
FIG. 12 is a view illustrating a waveform outputted by the photo interrupter when the reflection-type photo interrupter is re-inserted into the wrapper case in the absence of the coin wrapper.

FIG. 12 is a view illustrating a waveform outputted by the photo interrupter when the reflection-type photo interrupter is re-inserted into the wrapper case 43 in the absence of the coin wrapper 42.

Figure 13:
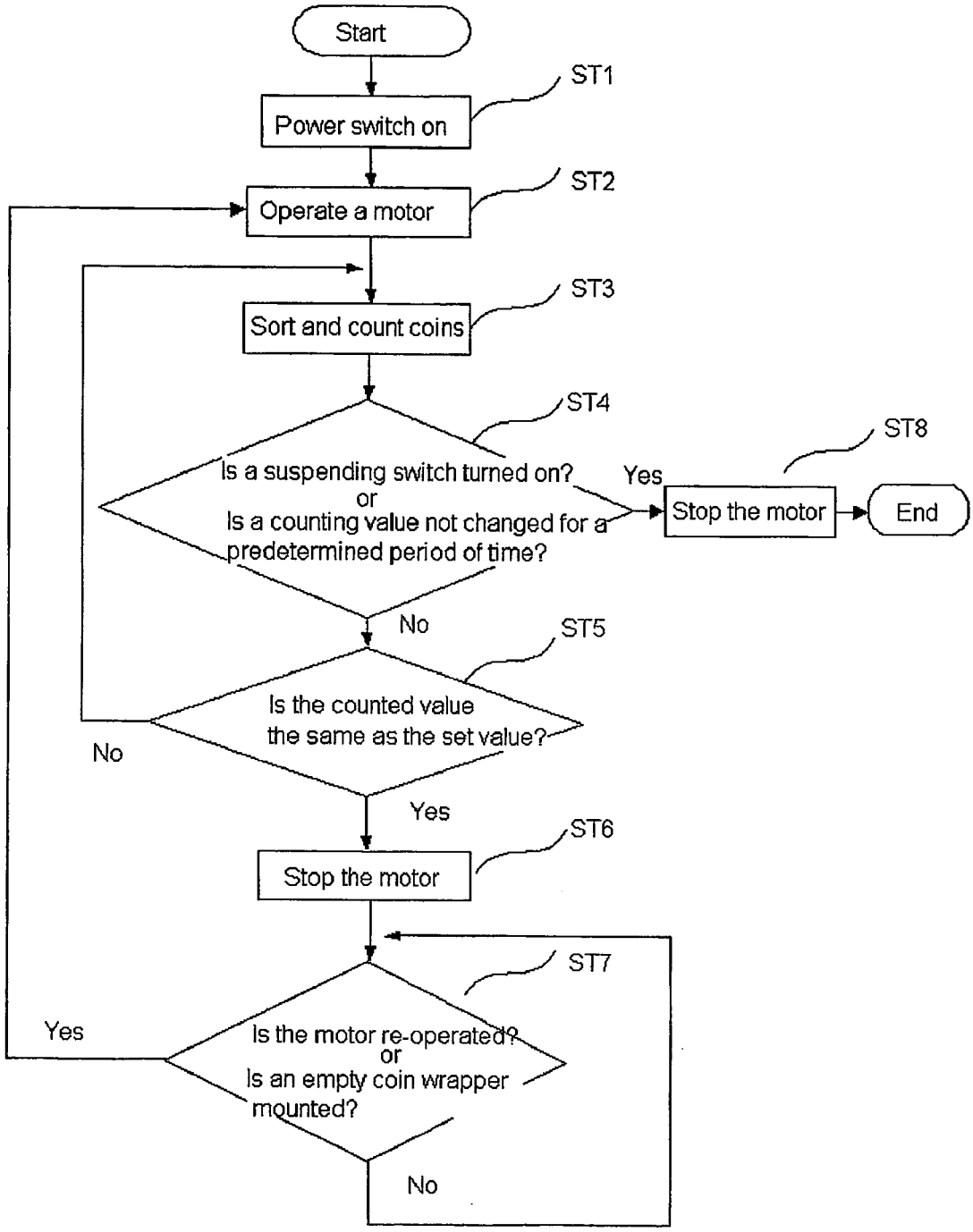
FIG. 13 is a schematic diagram exemplifying a method for operating the apparatus for sorting and counting coins according to the present invention.

FIG. 13 is a schematic diagram exemplifying a method for operating the apparatus for sorting and counting coins according to the present invention.

A power supply is switched on (ST1), and a motor begins to operate (ST2) so as to proceed with sorting and counting of coins (ST3). In the course of the sorting and counting process, if a suspending switch is turned on or a counting value is not changed for a predetermined period of time (ST4), the motor is suspended (ST8) upon determination that no coin exists to be counted. Then, the process is terminated. Or the apparatus waits for a next command.

Meanwhile, if the suspending switch is not turned on or the counted value is changed within a predetermined period of time, the coin sorting and counting process continues. The counted value is compared with the number of coins to be contained in the coin receiver, i.e., a set value. If the counted value is not the same as the set value (ST5), the coin sorting and counting process continues. Otherwise, the motor is suspended (ST6) because a predetermined number of coins have been contained in the coin receiver. If the coin wrapper is exchanged and an empty coin wrapper is mounted, the sensor senses the same, or the motor is re-operated once again (ST2) by means of the switch (ST7). The coin sorting and counting process continues thereafter.

While the invention has been shown and described with reference to a best mode for carrying out the invention, it will be understood by those skilled in the art that various changes in form and details may be made therein without departing from the spirit and scope of the invention as defined by the appended claims.

INDUSTRIAL APPLICABILITY

As described above, the apparatus for sorting and counting coins according to the present invention is capable of holding accurate number of coins in a coin wrapper by suspending a conveying container before a next coin of the same kind falls from a sorting hole after a predetermined number of coins have fallen from the sorting holes. The apparatus for sorting and counting coins according to the present invention is also capable of preventing coins from falling outside of the coin wrapper by structuring the wrapper case to have a height of the opposite upper side to be higher than the side where the coins fall. Thus, the coin wrapper can hold all the sorted coins. As a consequence, the present invention realized accurate counting and collecting of the coins regardless of the differences in thickness, distorted shapes, bouncing or sliding velocity of the coins. Thus, the present invention is highly effective and resolved the problems of the conventional apparatus for sorting and counting coins. In particular, the present invention can be used in financial institutes such as banks or in commercial transactions for sorting coins in a prompt and precise manner.

What is claimed is:

1. An apparatus for sorting and counting coins, comprising:

a bi-directionally rotatable motor;

a rotating shaft for conveying a rotating force generated by the motor;

a stopper in contact with the rotating shaft and having a tilted end so as to restrict counterclockwise rotation;

a spring for applying an elastic force to the stopper;

a conveying container engaged with the rotating shaft and having conveying holes on a side surface for loading each coin;

a supply control container formed on an upper side of the conveying container and having supply holes on a side surface for supplying a predetermined number of coins to the conveying container while rotating;

sorting holes being of different sizes to conform with the conveying holes for sorting coins in accordance with the sizes thereof;

a guide for guiding coins fallen from the sorting holes;

means for counting coins by using a non-contact type sensor; and means for containing a predetermined number of coins in a coin receiver by suspending the rotation of the conveying container after a predetermined number of coins have fallen in the coin receiver and before a next coin of the same kind falls from a sorting hole.

2. The apparatus of claim 1, further comprising:

means for sorting and counting coins by re-operating the conveying container once the coin receiver is re-mounted on the apparatus in an empty state after a predetermined number of coins are received by the coin receiver and removed from the same.

3. The apparatus of claim 1, wherein the means for counting coins counts coins by sensing side surfaces of the coins, which fall from the sorting holes, before the coins arrive at the guide by using a reflection-type photo interrupter.

4. The apparatus of claim 1, wherein the means for counting coins counts coins by sensing front or rear surfaces of the coins, which slide from the guide, by using a transmissive photo interrupter.

5. The apparatus of claim 1, wherein the means for counting coins counts coins by sensing front or rear surfaces of the coins, which slide from the guide, by using a luminous diode and a photo transistor.

6. The apparatus of claim 1, wherein the means for counting coins counts coins by sensing front or rear surfaces of the coins, which slide from the guide, by using a luminous diode and a photo diode.

7. The apparatus of claim 1, wherein the means for counting coins counts coins by sensing front or rear surfaces of the coins, which slide from the guide, by using a reflection-type photo interrupter.

8. The apparatus of claim 1, wherein the means for counting coins counts coins by sensing rear surfaces of the coins, which fall from the sorting holes, before the coins arrive at the guide by using a reflection-type photo interrupter.

9. The apparatus of claim 1, wherein the means for counting coins counts coins by sensing the coins, which slide from the guide, by using a luminous diode and a photo transistor.

10. The apparatus of claim 1, wherein the means for counting coins counts coins by sensing the coins, which slide from the guide, by using a luminous diode and a photo diode.

11. The apparatus of claim 1, wherein the coin receiver comprises a wrapper case and a coin wrapper, and is re-operated once the filled-in coin wrapper is removed therefrom and an empty coin wrapper is re-mounted thereon.

12. The apparatus of claim 11, wherein the wrapper case is structured to have a height of the side opposite from the side of coin entry that is greater than the height of the side of coin entry.

13. The apparatus of claim 2, wherein the means for sorting and counting coins by operating the conveying container senses a new coin wrapper by using a reflection-type photo interrupter.

14. The apparatus of claim 2, wherein the means for re-operating the conveying container uses a switch.

* * * * *